US010464093B2

(12) United States Patent
Rutz et al.

(10) Patent No.: US 10,464,093 B2
(45) Date of Patent: Nov. 5, 2019

(54) APPARATUS FOR THE TWO-SIDED COATING OF AT LEAST ONE RUNNING FLAT MATERIAL WEB

(71) Applicant: Lindauer DORNIER Gesellschaft mit beschraenkter Haftung, Lindau (DE)

(72) Inventors: Andreas Rutz, Lindau (DE); Andreas Herz, Sulzberg (DE)

(73) Assignee: Lindauer DORNIER Gesellschaft mit beschraenkter Haftung, Lindau (DE)

( * ) Notice: Subject to any disclaimer, the term of this patent is extended or adjusted under 35 U.S.C. 154(b) by 0 days.

(21) Appl. No.: 15/744,997

(22) PCT Filed: Jul. 11, 2016

(86) PCT No.: PCT/EP2016/066397
§ 371 (c)(1),
(2) Date: Jan. 15, 2018

(87) PCT Pub. No.: WO2017/021102
PCT Pub. Date: Feb. 9, 2017

(65) Prior Publication Data

US 2018/0207668 A1 Jul. 26, 2018

(30) Foreign Application Priority Data

Jul. 31, 2015 (DE) ..... 10 2015 112 659

(51) Int. Cl.
*B05B 15/68* (2018.01)
*B05B 15/70* (2018.01)
(Continued)

(52) U.S. Cl.
CPC ..... *B05B 15/68* (2018.02); *B05B 1/3026* (2013.01); *B05B 13/0207* (2013.01);
(Continued)

(58) Field of Classification Search
USPC ..... 118/410, 411, 419–421, 316, 323, 325; 239/601
See application file for complete search history.

(56) References Cited

U.S. PATENT DOCUMENTS 3,595,204 A 7/1971 McIntyre et al.
5,776,251 A * 7/1998 Irie ..... B05B 9/04 118/405
(Continued)

FOREIGN PATENT DOCUMENTS

CN 102216058 10/2011
CN 104384044 3/2015
(Continued)

OTHER PUBLICATIONS

German Office Action in German Patent Application No. 10 2015 112 659.1, dated Feb. 26, 2016, 6 pages, with partial English translation, 3 pages.
(Continued)

*Primary Examiner* — Yewebdar T Tadesse
(74) *Attorney, Agent, or Firm* — W. F. Fasse

(57) ABSTRACT

An apparatus has first and second coating nozzles for applying a liquid coating material respectively to two sides of a running flat material web, and has first and second rigid supply line sections for supplying the coating material to the respective coating nozzles. At least one of the coating nozzles is transferable from a working position to a maintenance position and back. In the working position, throughflow channels in the supply line sections communicate with one another to provide a throughflow of the coating material to the coating nozzles. When transferring at least one of the coating nozzles from the working position to the maintenance position, the rigid supply line sections are automatically moved relative to one another so that the throughflow
(Continued)

channels therein are interrupted so as to interrupt the flow of the coating material to this coating nozzle.

21 Claims, 5 Drawing Sheets

(51) Int. Cl.

| | |
|---|---|
| ***B05B 1/30*** | (2006.01) |
| ***B05B 13/02*** | (2006.01) |
| ***B05C 5/02*** | (2006.01) |
| ***B05C 9/04*** | (2006.01) |

(52) U.S. Cl.
CPC ..... *B05B 15/70* (2018.02); *B05C 5/0241* (2013.01); *B05C 5/0254* (2013.01); *B05C 9/04* (2013.01); *B05C 5/0245* (2013.01)

(56) References Cited

U.S. PATENT DOCUMENTS

| | | | | |
|---|---|---|---|---|
| 6,174,372 | B1 | 1/2001 | Yoshinaga et al. | |
| 8,808,794 | B2 | 8/2014 | Børsting et al. | |
| 2011/0111122 | A1* | 5/2011 | Mues ..... | H01M 2/145 427/209 |
| 2015/0238998 | A1 | 8/2015 | Huth et al. | |

FOREIGN PATENT DOCUMENTS

| | | |
|---|---|---|
| DE | 36 16 235 | 11/1987 |
| DE | 102011087611 | 6/2013 |
| DE | 102012217682 | 2/2014 |
| EP | 0 182 747 | 5/1986 |
| EP | 2 263 864 | 12/2010 |
| JP | 06-296931 A | 10/1994 |
| WO | WO 2010/061218 | 6/2010 |

OTHER PUBLICATIONS

Taiwanese Office Action and Search Report in Taiwanese Patent Application No. 105120508, dated Sep. 13, 2017, 3 pages, with partial English translation, 2 pages.

International Search Report of the International Searching Authority for International Application PCT/EP2016/066397, dated Oct. 25, 2016, 3 pages, European Patent Office, HV Rijswijk, Netherlands.

PCT International Preliminary Report on Patentability including English Translation of PCT Written Opinion of the International Searching Authority for International Application PCT/EP2016/066397, dated Feb. 6, 2018, 6 pages, International Bureau of WIPO, Geneva, Switzerland.

* cited by examiner

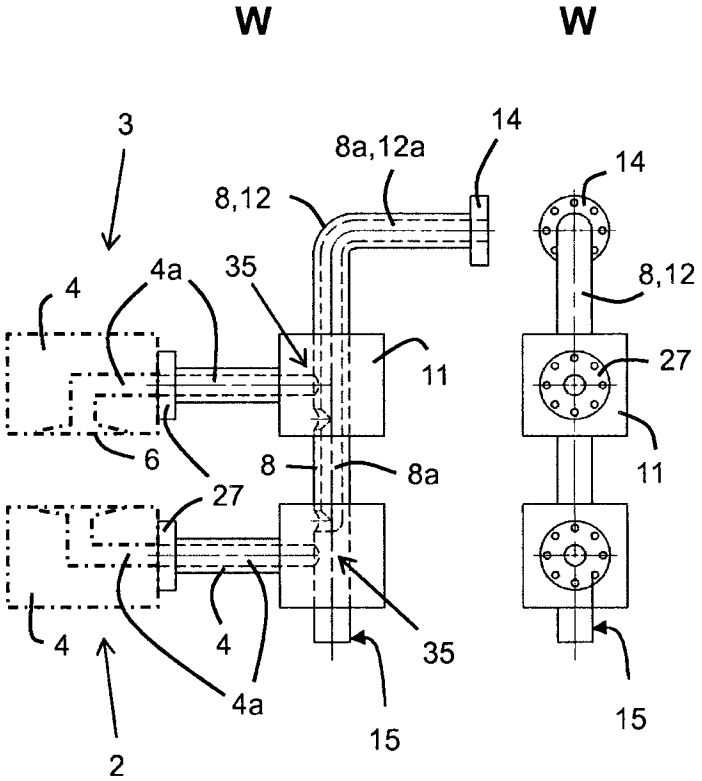
Fig. 12
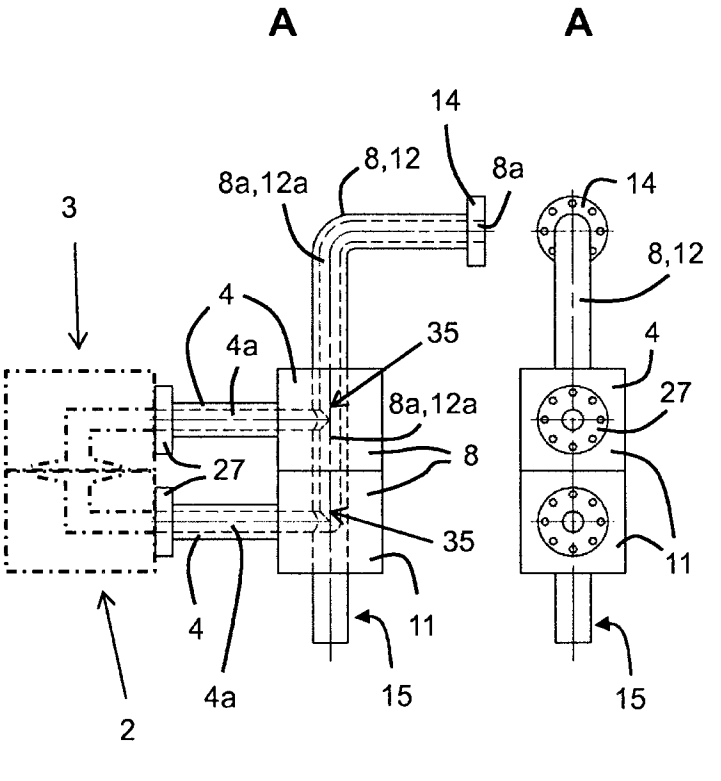
Fig. 11
Fig. 10
Fig. 9

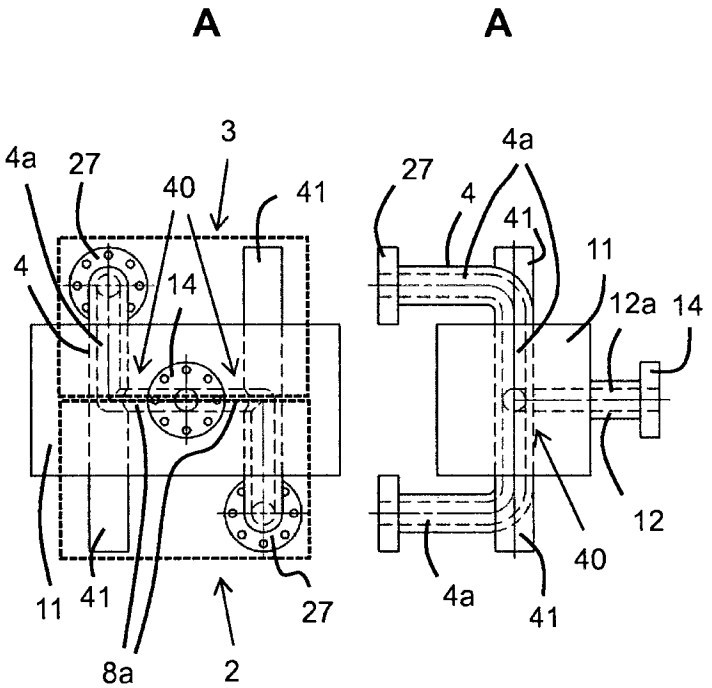
Fig. 13
Fig. 14
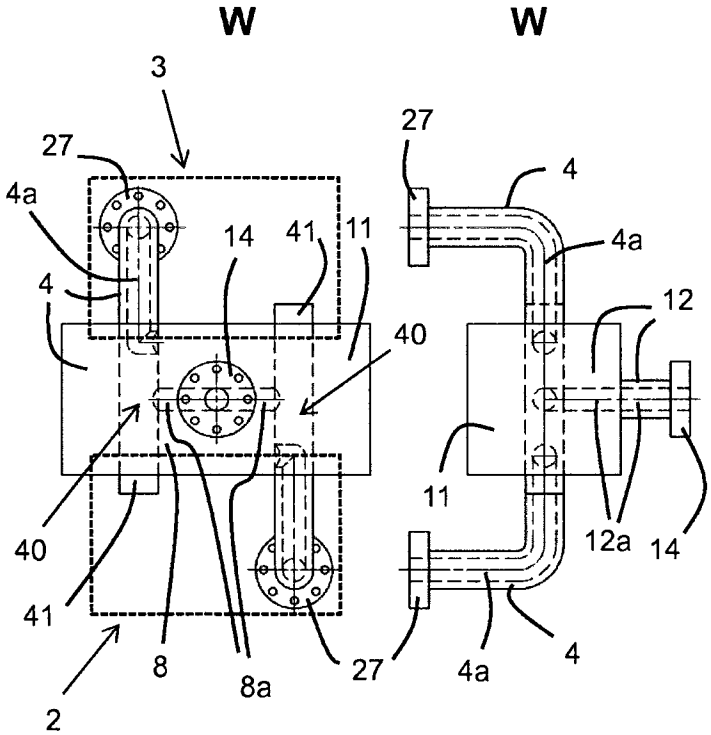
Fig. 15
Fig. 16

APPARATUS FOR THE TWO-SIDED COATING OF AT LEAST ONE RUNNING FLAT MATERIAL WEB

FIELD OF THE INVENTION

The present invention relates to an apparatus for the two-sided coating of at least one running flat material web.

BACKGROUND INFORMATION

Coating nozzles are known for the coating and consolidating or fixing of flat material webs, for example flat carbon fibers or carbon filaments running next to one another. These coating nozzles, often also referred to as pultrusion nozzles, serve for applying a hot coating liquid, which wets the fibers and flows between the fibers. Upon further guiding the flat material web through an oven, the coating liquid cools off, whereby the fibers are permanently adhesively bonded with one another and thereby a consolidated tape is obtained. This can then be rolled up and used in a later process for the production of light structural components.

The known coating nozzles comprise flexible, heatable supply lines, which consist of plastic, and through which molten coating material can be guided or fed. The use of flexible supply lines is necessary in order to be able to open and clean the nozzle during the production with only short standstill times, because during the impregnation, it often gives rise to the poking-up or jamming of damaged fibers, which then accumulate in the coating nozzle or nozzles. With the use of rigid lines, a simple opening for the purpose of cleaning is not possible.

The plastic supply lines on the one hand must withstand high pressures and on the other hand must ideally withstand high melt temperatures. In consideration of both of these points, however, the plastic supply lines are not optimal. For example, generally they can withstand only a melt temperature of up to 260° C. Thermoplastics such as e.g. PA6, PET etc. with higher melt temperatures and required processing pressures are therefore not usable. Additionally it is a factor that the part of the flexible supply line that feeds or guides the melt is not smooth but rather wavy. This leads to very greatly varying dwell times or residence times of the melt in the supply line, which leads to a very strong thermal breakdown or decomposition of parts of the melt.

SUMMARY OF THE INVENTION

It is an object of the present invention to provide a coating apparatus which makes possible a simple coating and especially also maintenance, and additionally ensures that coating material can be supplied to a flat material web without significant limitations with respect to the temperature and pressure of the coating material.

The above object can be achieved by an apparatus with the features according to an embodiment of the invention as set forth herein.

On the one hand, the apparatus according to the invention offers the advantage that rigid supply line sections are provided, which are significantly more easily heatable than flexible hoses. Thus, rigid supply line sections can consist especially of metal, preferably of stainless steel, which are surrounded outwardly by heating devices so that the coating material can flow through them at temperatures above 260° C. Thus, temperatures above 400° C. are easily reachable. In the present context, the term "rigid" means a non-flexible, immovable embodiment, that especially is not bendable by hand.

The invention thus makes it possible that very high working or processing temperatures of 300° C. and higher, and high working or processing pressures (approximately 200 bar) are utilizable. Moreover, an opening motion of the coating nozzles into the maintenance position, and a closing motion into their working position is possible, without requiring mounting devices or screws to be released.

A further advantage is that at least one of the coating nozzles, preferably both, can be transitioned or transferred from a working position into a maintenance position, whereby during this transitioning or transferring, a first rigid line section is moved relative to a second rigid line section, in order to stop the throughflow of the coating material. This embodiment has the advantage that the at least one coating nozzle is moved together with the first supply line section, especially preferably without an additional joint or the like between the coating nozzle and the first supply line section. In other words, the rigidly embodied first supply line section together with the associated coating nozzle is moved relative to the second rigidly embodied supply line section. In this regard, a single motion is preferably sufficient, namely a relative motion of the first supply line section relative to the second supply line section, both for transitioning or transferring the at least one coating nozzle from the working position into the maintenance position as well as for interrupting the flow of the coating material.

Preferably a wall of the first supply line section in the maintenance position of the associated coating nozzle seals an end side of the throughflow channel for the coating material formed in the second supply line section. This sealing function is advantageously realized by the relative motion of the first supply line section relative to the second supply line section, especially preferably by a single motion of the first supply line section and the associated coating nozzle. In this regard, the sealing is achieved in such a manner so that no coating material can exit out of the otherwise open end of the second throughflow channel, because the wall of the first supply line section seals this end. The advantage is that in the maintenance position, the coating material does not need to be redirected into a different line. Moreover, the coating material cannot drip out in an uncontrolled manner, which would represent a danger of injury. Finally, the hermetic closure of the supply line prevents the polymer from breaking down or decomposing oxidatively.

As explained above, it is preferred if the said first supply line section is embodied with an unvarying position relative to the associated coating nozzle. In other words, the first supply line section and the associated coating nozzle form one unit, which is moved as a whole when transitioning or transferring the coating nozzle from the working position into the maintenance position. This construction is simple and easy to handle, but simultaneously achieves the advantage of easy accessibility to the nozzle slit of the coating nozzle.

When transferring the at least one coating nozzle from the working position into the maintenance position and back, preferably the second supply line section is not moved along together with it. Preferably, truly only the first supply line section and the associated coating nozzle move during the stated is transferring, preferably—corresponding to the above statements—with a single motion.

Especially preferably, no flexible sections are present between the reservoir or supply unit for the coating material and the coating nozzles. In other words, all supply line sections that feed or guide the coating material are embodied as rigid. Especially in this regard, no flexibly embodied, that is to say non-rigid, components are present also between the first and second supply line sections, which are preferably rotationally and/or translationally movable relative to one another.

Preferably, a common or joint supply line section is provided for both coating nozzles. Coating material for both coating nozzles is then fed or supplied through this common supply line section, from which then two supply line sections lead away, whereby respectively one of these supply line sections leads respectively to one coating nozzle. These two said supply line sections are preferably embodied as first supply line sections, which—corresponding to the above statements—preferably form a rigid unit with the coating nozzle. The common supply line section is especially preferably also embodied as rigid. In a corresponding embodiment, a common rigid supply line section is provided, from which two rigid second supply line sections branch off, which then transition into respectively one first rigid supply line section, whereby corresponding to the invention the first and second supply line sections are movable relative to one another.

According to an advantageous embodiment, the said common supply line section is at least partially identical with at least one second supply line section, preferably with two second supply line sections, which respectively are connected with a first supply line section leading to the respective coating nozzle. In a corresponding embodiment, a common rigid supply line section leads to a first rigid supply line section, that is movably embodied relative to the common supply line section. Thus, in this case, the common supply line section and the second supply line section are identical—at least on this partial piece.

According to an advantageous embodiment, the first and the second supply line section of at least one and preferably of both coating nozzles are connected with one another, respectively with a thrust joint. In this regard, preferably the first supply line section is slidingly displaced or shifted relative to the second supply line section, for example linearly or in an arc motion. If, for example, the first supply line section together with the associated coating nozzle is moved away from the flat material web in a linear motion away from the second supply line section, then the nozzle slit of the coating nozzle is accessible in a simple manner.

The at least one coating nozzle can advantageously especially be embodied so that it is transferable through a linear motion from the working position into the maintenance position and through an opposite linear motion from the maintenance position into the working position. Hereby the first supply line section is also linearly slidingly shifted or displaced relative to the second supply line section. The second supply line section preferably remains stationary or fixed in location.

According to an alternative embodiment (which may, however, if applicable also be combinable with the above described embodiment), the first and the second supply line section of at least one and preferably both coating nozzles are respectively connected with one another by means of a rotation joint. With this pivoting or rotation motion, the first supply line section is moved relative to the second supply line section, which hereby preferably remains stationary or fixed in location, and therewith especially preferably also the at least one coating nozzle is transferred from the working position into the maintenance position and through an opposite rotation motion is transferred from the maintenance position into the working position.

In an embodiment that is preferred in this regard, the throughflow channels that are embodied in the first and second supply line section, are embodied aligned with one another radially in the rotation joint in the working position of the associated coating nozzle. During the transferring of this coating nozzle from the working position into the maintenance position, the first supply line section is rotationally shifted or displaced relative to the second supply line section in the circumferential direction of the rotation joint, so that the throughflow of the coating material is interrupted. The free end of the second supply line section, which in the working position of the coating nozzle transitions into a free end of the first supply line section, is hereby sealed in the maintenance position preferably by a convex wall of the first supply line section.

In the abovementioned embodiment it is preferred if the throughflow channel of the second supply line section runs or leads in the throughflow direction radially from the outside toward the inside to the first supply line section. The inwardly lying first supply line section, which is then preferably enclosed or surrounded by the second supply line section, then rotates within this second supply line section, while the latter preferably is stationary or fixed in location.

An advantageous embodiment of the first supply line section provides that the throughflow channel provided therein at first, that is to say in connection to the transition from the second supply line section, runs or leads in the throughflow direction radially with respect to the rotation axis of the rotation joint and thereafter in the axial direction of the rotation joint, preferably including or encompassing the longitudinal axis, in the direction toward the coating nozzle. This embodiment is, for example, realizable in a simple manner by two bores or bored holes that extend perpendicularly to one another and that transition into one another in the first supply line section that is preferably embodied as a block.

In an advantageous embodiment of the apparatus according to the invention, a toggle lever device is provided for transferring at least one of the coating nozzles from the working position into the maintenance position. The lever mechanism of the toggle lever makes it possible to be able to carry out a rapid and m forceful closing (transferring from the maintenance position into the working position) and opening (transferring from the working position into the maintenance position). The toggle lever device is preferably operable manually and/or pneumatically or hydraulically.

Especially preferably, the two coating nozzles in their respective working position are arranged lying opposite one another, whereby the flat material web to be coated runs between the nozzle slits. The two coating nozzles as well as their s associated first and second supply line section can especially be embodied symmetrically (whereby the symmetry plane is defined by the transport plane of the flat material web) and by means of the same kinematics, for example an abovementioned toggle lever device with two toggle levers. The above statements, especially m with regard to the rotation or thrust joints or the relative motions of the respective first supply line section relative to the respective second supply line section, then pertain especially preferably for both coating nozzles. The two coating nozzles can especially be transferable oppositely directed relative to one another from their respective working position into their maintenance position and back.

The apparatus according to the invention is embodied according to the preceding description, wherein the disclosed features can be present individually or in any desired combination.

The invention similarly relates to a method for producing prepregs (preimpregnated fibers) through coating of a fiber-containing flat material web, especially of glass or carbon filaments, by means of the above described apparatus, wherein the coating nozzles are transferred from a maintenance position into a working position, in order to apply coating material onto a running flat material web.

BRIEF DESCRIPTION OF THE DRAWINGS

Further advantages of the invention are described in the following example embodiments. It is shown by:

FIG. 9 a side view of an apparatus with two coating nozzles (illustrated with dashed lines) that are linearly slidable opposite one another, and that are located in working position;

FIG. 10 a front view onto the apparatus of FIG. 9 (coating nozzles not illustrated);

FIG. 11 a side view of the apparatus of FIGS. 8 and 9 with coating nozzles (illustrated with dashed lines) slidingly shifted or displaced into maintenance position;

FIG. 12 a front view onto the apparatus of FIG. 11 (coating nozzles not illustrated);

FIG. 13 a rear view of an alternative apparatus with two coating nozzles (illustrated with dashed lines) that are linearly slidable opposite one another, and that are located in working position;

FIG. 14 a side view of the apparatus of FIG. 13 (coating nozzles not illustrated);

FIG. 15 a rear view as in FIG. 13, however with supply line sections that are linearly slidingly shifted or displaced opposite one another (coating nozzles illustrated with dashed lines), and FIG. 16 a side view of the apparatus of FIG. 15 (coating nozzles not illustrated);

DETAILED DESCRIPTION OF EXAMPLE EMBODIMENTS OF THE INVENTION

In the following description, the same reference numbers are used for the same features that are identical and/or at least comparable in their embodiment and/or manner of operation in w various different embodiment forms. Insofar as these are not again explained in detail, then their embodiment and/or manner of operation corresponds to the embodiment and/or manner of operation of the previously already described features.

Figure 2:
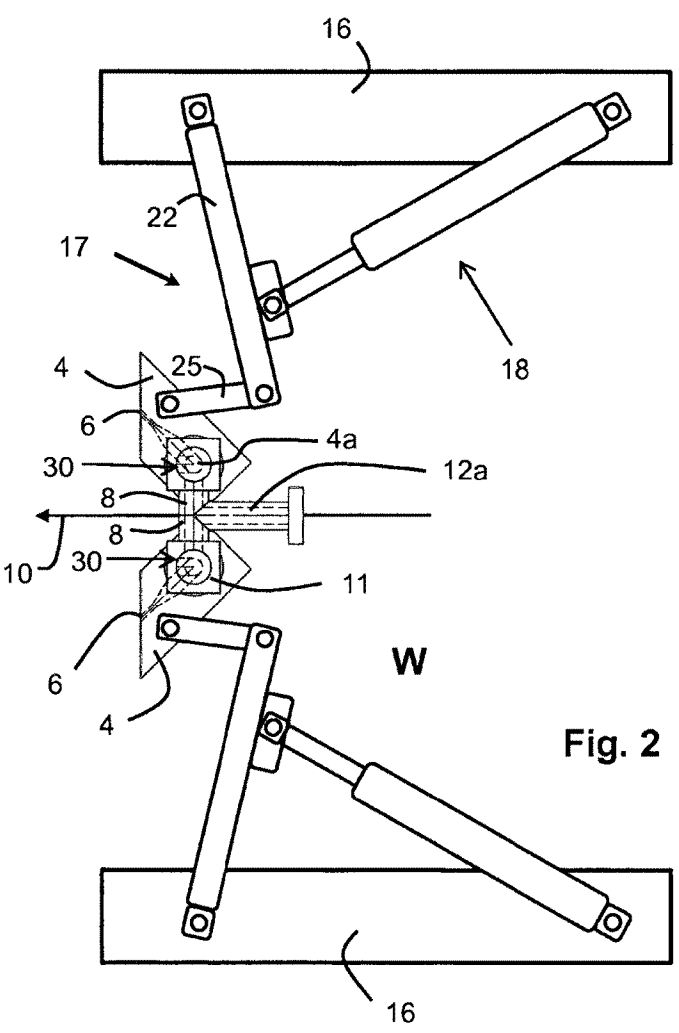
FIG. 2 a side view of the apparatus of FIG. 1 in maintenance position.
Figure 1:
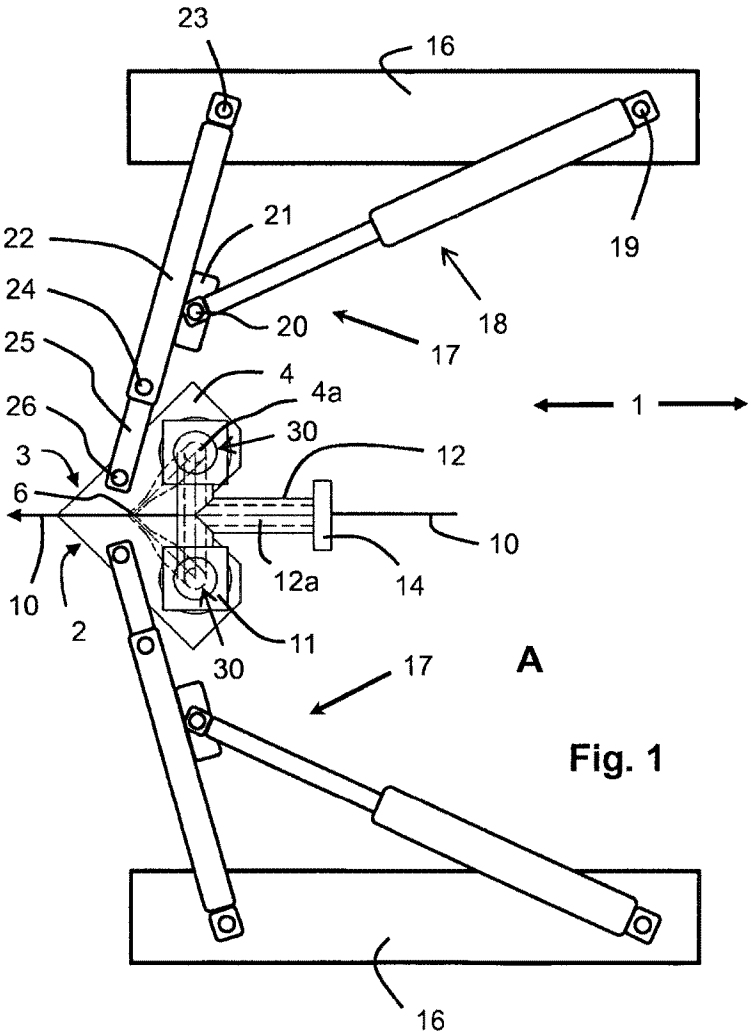
FIG. 1 a side view of an apparatus according to the invention with two coating nozzles located in working position, which are pivotable opposite one another by means of a toggle lever device.
Figure 5:
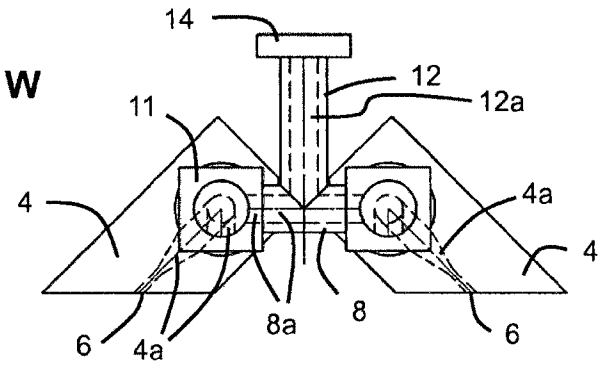
FIG. 5 a side view of the two coating nozzles of FIGS. 3 and 4, in maintenance position.
Figure 6:
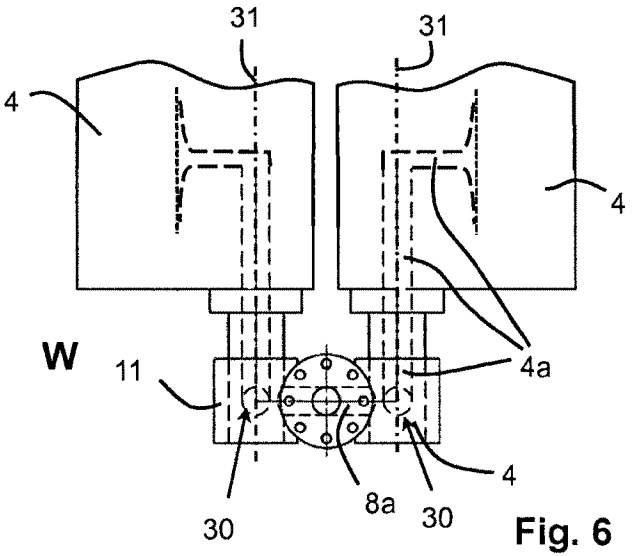
FIG. 6 a top plan view onto the two coating nozzles of FIGS. 3 to 5, in maintenance position.
Figure 3:
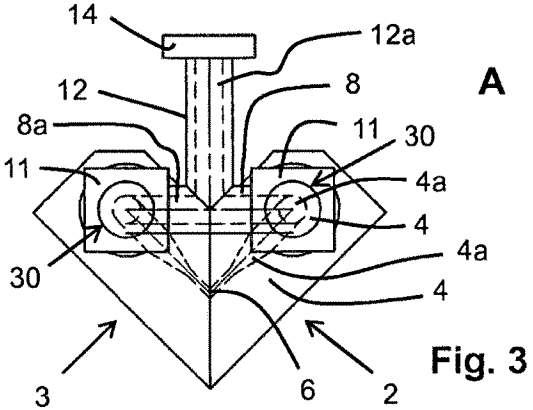
FIG. 3 a side view of the two coating nozzles of FIGS. 1 and 2, in working position (rotated by 90° relative to the illustration in FIG. 1)
Figure 4:
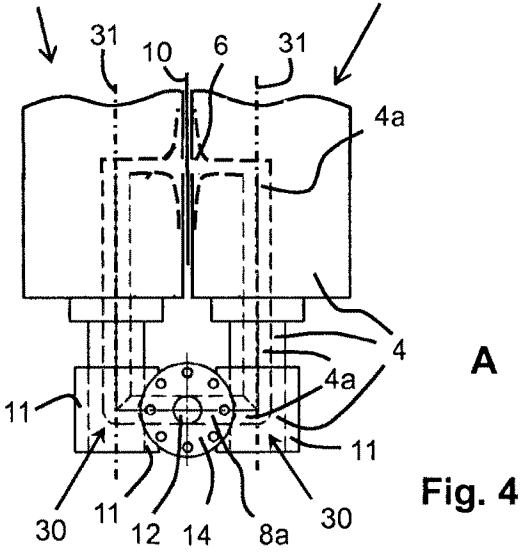
FIG. 4 a top plan view onto the two coating nozzles of FIG. 3, in working position.

In a side view, FIGS. 1 and 2 show an apparatus 1 with two coating nozzles 2, 3, which are reproduced alone in individual illustrations in FIGS. 3 to 6. In FIG. 1, the coating nozzles 2, 3 are illustrated in a working position A, in which their nozzle slits 6 lie opposite one another and a flat material web 10 is guided through between them. The flat material web 10 consists, for example, of parallel extending carbon filaments that are to be adhesively bonded with one another. For this, a molten coating material, for example a polyamide (e.g. PA6) or polyester (PET), with a temperature of approximately 300° C. and higher and a high working or processing pressure (e.g. at 200 bar) is applied by means of the coating nozzles 2, 3 onto the running flat material web 10 from both sides thereof. After leaving the coating nozzles 2, 3, the coating material cools down and thereby solidifies or consolidates the flat material web 10, which can then be further processed for the production of especially three-dimensional workpieces.

For supplying the fluid or liquid coating material, the example embodiment of FIGS. 1 to 8 comprises a common or joint supply line section 12, which is connected by means of a flange 14 onto a supply line section that is arranged upstream or before it and that leads to a reservoir or supply unit for the coating material (not illustrated). Downstream, two second supply line sections 8 branch off from the common supply line section 12, wherein the two second supply line sections 8 are embodied T-shaped together with the common supply line section 12. At the downstream end of each second supply line section 8, a first supply line section 4 is provided, whereby the respective first and second supply line section 4, 8 are connected with one another respectively by means of a rotation joint 30, which will be described further below. The respective first supply line section 4 leads to the coating nozzle 2 or respectively the coating nozzle 3, which respectively comprise a nozzle slit 6, which can be delivered or provided to the flat material web 10 in the working position A.

The first and second supply line sections 4, 8 as well as also the common supply line section 12 are embodied as rigid, that is to say not flexible, preferably of a metal and especially of stainless steel. They comprise throughflow channels 4*a*, 8*a* and 12*a*, which, in the position pivoted into the working position A, enable a throughgoing flow of coating material from the supply unit to the nozzle slits 6. For this, at least a few or some of the supply line sections 4, 8, 12 are surrounded at least section-wise with heating devices, for example heating wires (not illustrated). The supply line sections preferably of stainless steel provide excellent conduction of the heat, so that the coating material flowing through them can be maintained in the molten state without problems. It is noted that corresponding heating devices are also provided in the apparatuses of the remaining example embodiments (FIGS. 9 to 12 and FIGS. 13 to 16).

Furthermore, each one of the two first supply line sections 4 is connected rigidly with the respective coating nozzle 2 or 3, for example through welding or a screwed connection, so that only a common motion of the respective first supply line section 4 and coating nozzle 2 or 3 is possible. On the other hand, the second supply line sections 8 always remain in their position; during the transferring, only the respective first supply line section 4 and the associated coating nozzle 2 or 3 are moved from the working position A into the maintenance position W and back.

Figure 7:
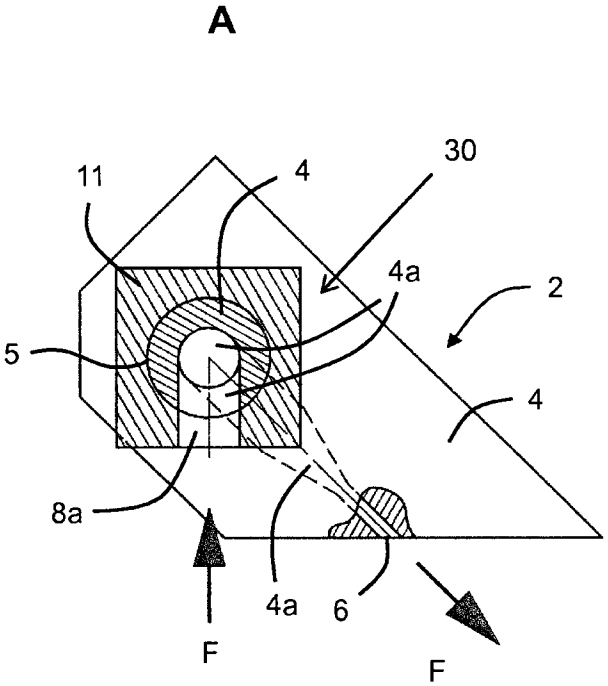
FIG. 7 a sectioned side view of a coating nozzle of FIGS. 3 to 6, in working position.

In the working position A, the respective first and second supply line section 4, 8 are oriented to one another in such a manner so that their throughflow channels 4*a*, 8*a* adjoin on one another in order to enable the throughflow of the coating material to the respective coating nozzle 2, 3. For this, according to the present example embodiment, the throughflow channel 8*a* of the second supply line section 8 is guided or led in the throughflow direction radially from the outside toward the inside to the first supply line section 4. Next subsequently—seen in the throughflow direction—the throughflow channel 4*a* comprises a 90° bend or curve and runs in the axial direction of the throughflow channel 4*a*, in order to then open and transition into the nozzle slit 6—again after a 90° bend or curve. This subject matter is illustrated more exactly in a side sectional view in FIGS. 7 and 8. In FIG. 7, the throughflow channel 8*a* of the second supply line section 8 leads from the bottom in the radial direction of the first supply line section 4 and transitions in a throughgoing or continuous manner into its throughflow channel 4*a*. Connected thereto (perpendicularly to the image plane of FIG. 4), the throughflow channel 4*a* extends in the axial direction of the first supply line section 4. The flow of the coating material is identified with arrows F (FIG. 7).

Figure 8:
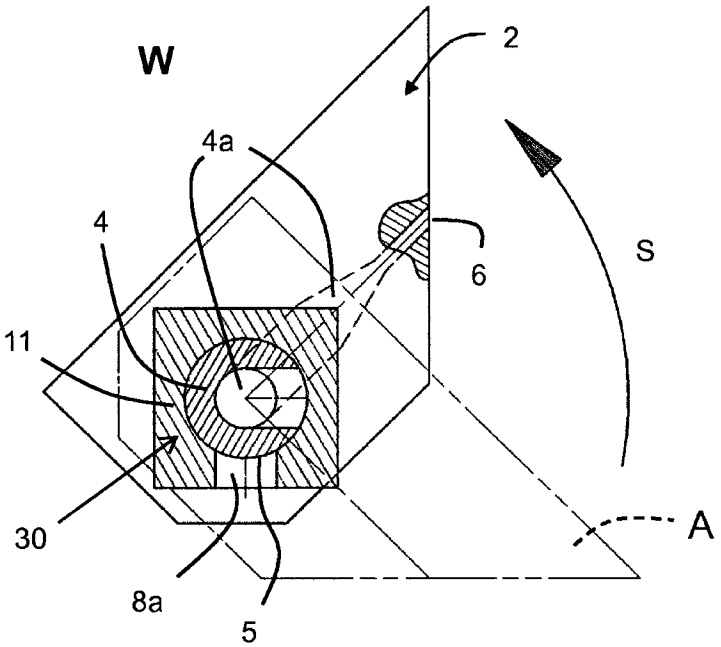
FIG. 8 a sectioned side view of a coating nozzle as in FIG. 7, however in maintenance position.

In FIG. 8, the first supply line section 4 and the coating nozzle 2 are illustrated pivoted by 90° relative to the working position A into the maintenance position W, see arrow S in FIG. 8. During this pivoting, the convex wall 5 of the first supply line section 4 seals the free or open end of the throughflow channel 8*a* of the second supply line section 8. Thereby the convex wall 5 of the first supply line section 4 slides along the open end of the throughflow channel 8*a*, until it is closed by the said convex wall 5. Thereby the flow of the coating material is stopped by the transferring of the coating nozzle 2 or 3 from the working position A into the maintenance position W—and is again released or permitted by the corresponding reverse motion.

As indicated above, the two coating nozzles 2, 3 are respectively embodied to be pivotable by means of a rotation joint 30 about respectively a pivot axis 31 (see FIGS. 4 and 6), so that the coating nozzles 2, 3 are pivotable from a working position A (FIGS. 1, 3, 4, 7) into a maintenance position W (FIGS. 2, 5, 6, 8) and back. For this, the first supply line sections 4 are rotatably supported in respectively one stationary bearing element 11 (see FIGS. 4, 6, 7, 8). The pivot angle for each coating nozzle 2, 3 amounts to preferably 90°, so that the entire angle between the two coating nozzles 2, 3 in the pivoted-open state (see FIG. 5) amounts to 180°. As can be seen especially in FIGS. 2 and 5, the two nozzle slits 6 are comfortably accessible without problems when the coating nozzles 2, 3 are pivoted into the maintenance position W, in order to remove, for example, compacted or upset fibers or broken filament pieces from them.

In order to realize the mentioned pivoting motion, a toggle lever device 17 is provided, which presently provides one toggle lever mechanism per coating nozzle 2 or 3. For this, respectively a telescopic spring 18 is pivotably jointed by a joint 19 on a base frame 16. The telescopic spring 18 can be actuated manually and/or pneumatically or hydraulically. The other end of the telescopic spring 18 is pivotably jointed onto a connecting piece 21 by means of a joint 20. The connecting piece 21 is connected with a rod 22, of which one end is similarly pivotably jointed on the base frame 16 by means of a joint 23 and of which the other end is pivotably jointed onto a further rod 25 by means of a joint 24. In turn, this rod 25 is pivotably jointed onto the coating nozzle 3 by means of a joint 26 (an analogous arrangement pertains for the coating nozzle 2). In FIG. 1, the telescopic spring 18 is located in the extended state or condition, whereby the toggle lever presses the coating nozzle 3 (or 2) into the working position A. If the telescopic spring 18 is transferred into the retracted position (FIG. 2), then the associated coating nozzle 3 or 2 including the respective first supply line section 4 pivots into the maintenance position W due to the kinking or toggling of the rod 25 relative to the rod 22. This motion is reversible by extending the telescopic spring 18.

As can additionally be seen from FIGS. 1 and 2, the two toggle lever mechanisms can operate independently of one another, so that also only one of the two coating nozzles 2 or 3 is pivoted (for example into the maintenance position W for cleaning the nozzle slit 6), while the other coating nozzle 3 or 2 remains in its current momentary position.

An alternative embodiment for realizing a relative motion of the first and second supply line section 4, 8 is illustrated in FIGS. 9 to 12. Instead of a rotation joint 30 (FIGS. 1 to 8), a thrust joint 35 is provided, with which the first supply line section 4 and therewith also the coating nozzle 2 or 3 connected to it by means of respectively a flange 27 (which is shown only in FIGS. 9, 11, 13 and 15 with dashed lines for better overview clarity), can be linearly shifted or displaced in order to transfer them from a working position A (FIGS. 9 and 10) into a maintenance position W (FIGS. 11 and 12). For this, respectively one of the two supply line sections 4, 8 is embodied section-wise in respectively one of two slide bearing elements 11, which respectively comprise two bores or bored holes that are perpendicular to one another. The one bore forms a part of the throughflow channel 4*a* of the first supply line section 4, while the other extends perpendicularly to the first mentioned one and embodies a part of the throughflow channel 8*a* of the second supply line section 8. The two bearing elements 11 are thus also a part of the respective first supply line sections 4 and a part of the respective second supply line sections 8.

In the maintenance position W, the two coating nozzles 2, 3 are spaced apart relatively far from one another, so that they are relatively easily accessible from the bottom side or the side of the nozzle slits 6. In the working position A, the two coating nozzles 2, 3 form a thin gap between them, between which the flat material web 10 is guided through (not shown in FIGS. 9 to 10; the through-running direction of the flat material web extends into the drawing plane of FIGS. 9 and 11).

In the side view of FIG. 9 and the front view of FIG. 10, a common or joint supply line section 12 is reproduced, which is connectable by means of a flange 14 with a reservoir or supply unit (again not illustrated). The common supply line section 12 has this name because it supplies coating material to both coating nozzles 2, 3. In the illustrated example embodiment, the common supply line section 12 is also a part of the second supply line section 8, relative to which the second coating nozzle 3 (which is the upper one in FIGS. 9 to 12) is slidably arranged. In the further extension of this common supply line section 12, it transitions into a single second supply line section 8 after passing the upper thrust joint 35 for the second coating nozzle 3, whereby this second supply line section 8 leads to the lower thrust joint 35 for the first coating nozzle 2. The entire second supply line section 8 from the flange 14 until its free end that also passes the lower thrust joint 35 is embodied as a rigid pipe 15, along which the two rigid first supply line sections 4 and the coating nozzles 2, 3 connected with it are linearly slidably arranged.

The free end of the respective first supply line sections 4 seals respectively one opening in the second supply line sections 8, in order to enable a throughflow through the throughflow channels 4*a*, 8*a* thereof to the respective coating nozzle 2, 3 in the working position A (FIGS. 9 and 10). Upon the sliding displacement of the coating nozzles 2, 3 toward the bottom or toward the top, the two openings of the second supply line sections 8 are sealed by the walls of the bored hole running parallel to the pipe 15 in the bearing elements 11. The open ends of the throughflow channels 4*a* facing toward the pipe 15, on the other hand, are sealed by the wall of the pipe 15, so that a return flow of the coating material is prevented.

FIGS. 13 to 16 illustrate a further variant of a linearly slidable arrangement of the first supply line sections 4, as well as of the coating nozzles 2 or 3 rigidly connected therewith (only reproduced in FIGS. 13 and 15 and there also shown only in dashed lines) on the one hand, and of the second supply line sections 8 on the other hand. The corresponding thrust joints 40 of this embodiment are embodied similarly to the thrust joints 35 according to FIGS. 9 to 12.

Corresponding to the example embodiment of FIGS. 13 to 16, there is provided a common supply line section 12, which is connected by means of a flange 14 to a reservoir or supply unit (not illustrated) arranged upstream—if applicable via further intermediately connected supply line sections—and two short second supply line sections 8 branch off in opposite directions from the common supply line section 12. At their ends, these short second supply line sections 8—in the working position A of the coating nozzles 2, 3—abut on the free ends of first supply line sections 4, which run at an angle of 90° in opposite directions to the coating nozzles 2, 3. The first supply line sections 4 and the coating nozzles 2, 3 are again in turn connected with one another by flanges 27.

The two first supply line sections 4 are again in turn led or formed in a block-like bearing element 11, whereby each first supply line section 4 comprises a cylindrical extension piece 41 without a bored hole, which extension piece 41 is connected integrally as one piece with the respective supply line section 4 and extends in the direction away from the respective flange 27. In the maintenance position W (FIGS. 15 and 16), these extension pieces 41 seal the free open ends of the second supply line sections 8. In the working position A (FIGS. 13 and 14), on the other hand, the throughflow channels 4*a*, 8*a* again in turn enable a through-going flow of the coating material to the two coating nozzles 2, 3. For this, each throughflow channel 4*a* is first formed by a bored hole extending parallel to the throughflow channel 8*a* in the bearing element 11, which bored hole transitions into a supply line section 4*a* that extends perpendicularly thereto and that is once again bent by 90° on its path to the coating nozzle 2 or 3, until it ends in the respective flange 27.

All of the fit tolerances in the area of the parts that rotate or slide relative to one another are embodied so tight and with such a smooth surface quality, so that a sealing is ensured due to the tight gap at the given viscosity of the melt.

Regarding the example embodiment of FIGS. 13 to 16, it is to be mentioned that parts of the supply line sections 4, 8 and 12 are embodied in the bearing element 11.

The invention makes it possible to produce prepregs through coating a fiber-containing flat material web 10, especially of glass or carbon filaments, by means of one of the above described apparatuses, wherein the coating nozzles are transferred from the maintenance position W into a working position A in order to apply coating material onto the running flat material web 10.

The present invention is not limited to the illustrated and described example embodiments. Derivations or modifications within the scope of the patent claims are also possible just like a combination of the features, even when these are illustrated and described in different example embodiments. For example it is possible to coat two or more flat material webs simultaneously, in that two or more such flat material webs run next to one another through the apparatus according to the invention.

REFERENCE NUMBER LIST

1 apparatus
2 first coating nozzle
3 second coating nozzle
4 first supply line section
4*a* throughflow channel
5 convex wall
6 nozzle slit
8 second supply line section
8*a* throughflow channel
10 flat material web
11 bearing element
12 common or joint supply line section
12*a* common or joint throughflow channel
14 flange
15 pipe
16 base frame
17 toggle lever device
18 telescopic spring
19 joint
20 joint
21 connecting piece
22 rod
23 joint
24 joint
25 rod
26 joint
27 flange
30 rotation joint
31 pivot axis
35 thrust joint
40 thrust joint
41 extension piece
A working position
W maintenance position
F flow of the coating material
S pivoting motion

The invention claimed is:

1. An apparatus for two-sided coating of at least one running flat material web, comprising a first coating nozzle and a second coating nozzle, wherein the first coating nozzle is providable to the first side of the flat material web and the second coating nozzle is providable to the second side of the flat material web, in order to coat the respective side of the flat material web, and wherein the first and second coating nozzles include at least one transferable coating nozzle that is transferable from a working position into a maintenance position and back; and comprising first and second rigid supply line sections with throughflow channels that are embodied respectively therein and that are connected with one another in the working position and that ensure a throughflow for supplying a hot liquid coating material to the respective coating nozzle, wherein, during the transferring of the at least one transferable coating nozzle from the working position into the maintenance position, the first rigid supply line section and the second rigid supply line section, which in the working position enable a throughflow of the coating material to the respective transferable coating nozzle, are automatically moved relative to one another so that the throughflow channels are moved relative to one another in order to interrupt the throughflow of the coating material to the respective transferable coating nozzle.

2. The apparatus according to claim 1, characterized in that the throughflow channel embodied in the second rigid supply line section, during the transferring of the associated coating nozzle from the working position into the maintenance position, is sealed on an end-side by a wall of the first rigid supply line section.

3. The apparatus according to claim 1, characterized in that said first rigid supply line section is embodied with an invariable position relative to the associated coating nozzle, and is moved along with the associated coating nozzle during the transferring of the associated coating nozzle from the working position into the maintenance position.

4. The apparatus according to claim 1, characterized in that said second rigid supply line section is embodied so that it is not also moved along during the transferring of one or both coating nozzles from the working position into the maintenance position and back.

5. The apparatus according to claim 1, characterized in that all supply line sections leading from a supply unit for the coating material to the coating nozzles are embodied rigid.

6. The apparatus according to claim 1, further comprising a common supply line section that is provided for both coating nozzles, from which two of the second rigid supply line sections lead away, whereby respectively one of the two second rigid supply line sections leads to respectively one of the coating nozzles.

7. The apparatus according to claim 6, characterized in that the common supply line section and at least one of the second rigid supply line sections are at least partially identical.

8. The apparatus according to claim 1, characterized in that the first and second rigid supply line sections are connected with one another via a rotation joint.

9. The apparatus according to claim 8, characterized in that the at least one transferable coating nozzle is transferable by a rotation motion from the working position into the maintenance position and is transferable by an opposite rotation motion from the maintenance position into the working position, wherein also the first rigid supply line section is rotationally moved relative to the second rigid supply line section.

10. The apparatus according to claim 9, characterized in that the throughflow channels are embodied radially aligned with one another in the working position of the at least one transferable coating nozzle, and characterized in that during the transferring of the associated coating nozzle from the working position into the maintenance position, the first and second rigid supply line sections are moved opposite one another in the circumferential direction of the rotation joint.

11. The apparatus according to claim 10, characterized in that the throughflow channel of the second rigid supply line section is led in the throughflow direction radially from outside inwardly to the first rigid supply line section.

12. The apparatus according to claim 11, characterized in that the throughflow channel of the first rigid supply line section is led in the throughflow direction radially with respect to a rotation axis of the rotation joint and then in an axial direction to the associated coating nozzle.

13. The apparatus according to claim 1, further comprising a toggle lever device for transferring the at least one transferable coating nozzle from the working position into the maintenance position.

14. The apparatus according to claim 13, wherein the toggle lever device is manually operable.

15. The apparatus according to claim 13, wherein the toggle lever device is pneumatically or hydraulically assisted.

16. The apparatus according to claim 1, characterized in that the first and second rigid supply line sections are connected with one another via a thrust joint.

17. The apparatus according to claim 16, characterized in that the at least one transferable coating nozzle is transferable by a linear motion from the working position into the maintenance position and is transferable by an opposite linear motion from the maintenance position into the working position, wherein also the first rigid supply line section is linearly slidingly displaced relative to the second rigid supply line section.

18. The apparatus according to claim 1, characterized in that both coating nozzles are arranged lying opposite one another in their respective working position.

19. The apparatus according to claim 1, characterized in that both coating nozzles are transferable coating nozzles that are transferable opposite one another from their respective working position into their maintenance position and back.

20. The apparatus according to claim 1, wherein both of the coating nozzles are respectively transferable coating nozzles that are transferable from the respective working position into the respective maintenance position thereof.

21. A method of using the apparatus according to claim 1 for producing a prepreg by coating the running flat material web, which comprises glass or carbon filaments, wherein the coating nozzles are transferred from the maintenance position into the working position in order to apply the coating material onto the running flat material web.

* * * * *